US011117726B2

(12) United States Patent
Herrington et al.

(10) Patent No.: US 11,117,726 B2
(45) Date of Patent: Sep. 14, 2021

(54) METHOD OF FORMING A GUSSETED STAND-UP POUCH

(71) Applicant: 1958658 Ontario Inc., Campbellville (CA)

(72) Inventors: Jeffrey G. Herrington, Nassagaweya (CA); Michael L. Bedrosian, Guelph (CA)

(73) Assignee: 1958658 Ontario Inc., Campbellville (CA)

( * ) Notice: Subject to any disclaimer, the term of this patent is extended or adjusted under 35 U.S.C. 154(b) by 253 days.

(21) Appl. No.: 16/155,492

(22) Filed: Oct. 9, 2018

(65) Prior Publication Data

US 2019/0337698 A1 Nov. 7, 2019

Related U.S. Application Data

(60) Provisional application No. 62/667,329, filed on May 4, 2018.

(51) Int. Cl.
*B65D 75/00* (2006.01)
*B65D 75/52* (2006.01)
*B65D 75/58* (2006.01)

(52) U.S. Cl.
CPC ..... *B65D 75/008* (2013.01); *B65D 75/522* (2013.01); *B65D 75/527* (2013.01);
(Continued)

(58) Field of Classification Search
CPC .. B65D 75/008; B65D 75/522; B65D 75/527; B65D 75/5805; B65D 75/5877;
(Continued)

(56) References Cited

U.S. PATENT DOCUMENTS 2,205,437 A * 6/1940 Ringler ..... B65D 75/38 206/422
2,565,622 A * 8/1951 Orr ..... B65D 31/142 383/206

(Continued)

FOREIGN PATENT DOCUMENTS

CA 2905469 A1 3/2017
DE 9006144 U 9/1990

(Continued)

OTHER PUBLICATIONS

International Search Report for International Application No. PCT/IB2019/053613, dated Aug. 16, 2019 (3 pages).

(Continued)

*Primary Examiner* — Thanh K Truong
*Assistant Examiner* — Scott A Howell
(74) *Attorney, Agent, or Firm* — Nixon Peabody LLP

(57) ABSTRACT

A gusseted stand-up flexible pouch including a pouch-forming structure. The pouch-forming structure including first and second body panels, first and second side gussets, a bottom gusset and at least one interior gusset. The bottom gusset extends between the first and second body panels. Each of the first and second side gussets is joined to the first and second body panels. The at least one interior gusset is joined to the first and second body panels. The at least one interior gusset is located between the first and second side gussets. The at least one interior gusset divides an interior of the stand-up flexible pouch into a plurality of compartments.

19 Claims, 12 Drawing Sheets

(52) U.S. Cl.
CPC ..... *B65D 75/5805* (2013.01); *B65D 75/5877* (2013.01); *B65D 2575/586* (2013.01)

(58) Field of Classification Search
CPC ..... B65D 2575/586; B65D 75/34; B65D 21/0206; B65D 1/30
See application file for complete search history.

(56) References Cited

U.S. PATENT DOCUMENTS

| | | | | | |
|---|---|---|---|---|---|
| 2,805,814 | A | | 9/1957 | Calasibetta | |
| 3,173,602 | A | * | 3/1965 | Clipner | B65D 31/12 383/37 |
| 3,332,548 | A | * | 7/1967 | Piazze | B65D 75/527 206/525 |
| 3,549,451 | A | | 12/1970 | Kugler | |
| 3,580,486 | A | | 5/1971 | Kugler | |
| 3,599,388 | A | * | 8/1971 | Feingold | B65B 9/087 53/455 |
| 4,099,665 | A | * | 7/1978 | Bergstein | B65D 5/068 229/117.34 |
| 4,164,170 | A | | 8/1979 | Nordita | |
| 4,452,378 | A | | 6/1984 | Christine | |
| 4,696,403 | A | * | 9/1987 | Hoover | B29C 65/028 206/428 |
| 4,759,467 | A | | 7/1988 | Byrne | |
| 4,807,754 | A | | 2/1989 | Rowe | |
| 4,810,109 | A | * | 3/1989 | Castel | B65D 75/008 383/105 |
| 4,872,766 | A | * | 10/1989 | Dancy | B65D 31/12 383/10 |
| 5,547,284 | A | * | 8/1996 | Imer | B65D 75/5866 383/104 |
| 5,669,504 | A | | 9/1997 | Leone | |
| 5,924,573 | A | | 7/1999 | Piraneo | |
| 5,938,337 | A | | 8/1999 | Provan | |
| 6,036,004 | A | * | 3/2000 | Bowen | A47J 36/28 206/219 |
| 6,047,817 | A | | 4/2000 | Taylor | |
| 6,092,933 | A | * | 7/2000 | Treu | B65D 75/008 383/104 |
| 6,126,315 | A | * | 10/2000 | Ichikawa | B65D 31/10 383/43 |
| 6,397,560 | B1 | * | 6/2002 | Weder | B65D 31/00 150/154 |
| 6,409,386 | B1 | * | 6/2002 | Trani | B65D 75/008 383/104 |
| 6,425,847 | B1 | * | 7/2002 | Broenstrup | B31B 70/00 493/186 |
| 6,669,615 | B2 | | 12/2003 | DeMatteis | |
| 6,796,932 | B2 | * | 9/2004 | Kuge | B65D 31/10 493/189 |
| 6,807,794 | B2 | * | 10/2004 | Ausnit | B65B 9/02 493/114 |
| 6,921,204 | B2 | * | 7/2005 | Edwards | B65D 33/02 222/105 |
| 7,153,026 | B2 | | 12/2006 | Galomb | |
| 7,331,917 | B2 | | 2/2008 | Totani | |
| 7,661,558 | B2 | * | 2/2010 | De Laforcade | B65D 81/3261 222/94 |
| 9,050,770 | B1 | * | 6/2015 | Russell | B31B 70/60 |
| 9,126,383 | B2 | | 9/2015 | Yeager | |
| 9,272,481 | B2 | | 3/2016 | Yeager | |
| 9,365,011 | B1 | | 6/2016 | Russell | |
| 9,516,935 | B2 | * | 12/2016 | Rohe | A45C 7/0086 |
| D790,362 | S | | 6/2017 | Bell | |
| D814,315 | S | | 4/2018 | Bell | |
| 9,962,898 | B1 | | 5/2018 | Russell | |
| 9,963,272 | B2 | | 5/2018 | Trollen | |
| 10,196,192 | B2 | | 2/2019 | Gum | |
| 2006/0219719 | A1 | * | 10/2006 | Dixon | B65D 5/48002 220/495.06 |
| 2007/0189640 | A1 | | 8/2007 | Linton | |
| 2009/0142006 | A1 | | 6/2009 | Wine | |
| 2009/0152161 | A1 | | 6/2009 | St. Cyr | |
| 2011/0019942 | A1 | * | 1/2011 | Piraneo | B65D 31/10 383/104 |
| 2012/0195532 | A1 | | 8/2012 | Koesters | |
| 2013/0139473 | A1 | * | 6/2013 | Beer | B31B 70/60 53/452 |
| 2015/0158635 | A1 | * | 6/2015 | Gum | B65D 75/008 383/25 |

FOREIGN PATENT DOCUMENTS

| | | | | |
|---|---|---|---|---|
| DE | 102013008978 | A1 | | 12/2014 |
| DE | 102016125802 | A1 | | 6/2018 |
| EP | 2332853 | A1 | | 6/2013 |
| GB | 937956 | A | | 9/1963 |
| JP | 2003-335347 | A | | 11/2003 |
| JP | 2006-131250 | A | | 5/2006 |
| JP | 5519063 | B1 | | 6/2014 |
| JP | 2014-177052 | A | | 9/2014 |
| JP | 2014177052 | A | * | 9/2014 |
| JP | 2015-030231 | A | | 2/2015 |
| WO | WO 2006/050748 | A1 | | 5/2006 |

OTHER PUBLICATIONS

Written Opinion of International Searching Authority for International Application No. PCT/IB2019/053613, dated Aug. 16, 2019 (6 pages).
"DUOPACK—Patented flexible double stand-up pouch," downloaded on Dec. 11, 2018 from https://duopack/org/patents-on-flexible-packaging-for-two-products (7 pages).
Machine Translation of DE-102016125802-A1.
Machine Translation of DE-102013008978-A1.

* cited by examiner

METHOD OF FORMING A GUSSETED STAND-UP POUCH

CROSS-REFERENCE TO RELATED APPLICATION

The present invention claims priority to U.S. Provisional Application No. 62/667,329 filed on May 4, 2018, which is incorporated herein by reference in its entirety.

FIELD OF THE INVENTION

The present invention relates generally to stand-up flexible pouches for packaging. More specifically, the present invention relates to gusseted stand-up flexible pouches with multiple compartments or chambers.

BACKGROUND OF THE INVENTION

Various types of stand-up flexible pouches or packages are known in the art. These stand-up flexible pouches are widely used for packaging liquids, pastes, granulars, powders and the like. Stand-up pouches are designed to stand on their own once they are filled with product. The bottom gusset of the pouches expands when filled, which gives the pouch a solid base on which to stand. Manufacturers desire stand-up pouches because, when they are empty, they weigh very little and can be stored completely flat. Stand-up pouches also take up much less shelf space than traditional boxes, bottles or cans. Since space costs money, whether in inventory or in freight, stand-up flexible pouches assist in decreasing the costs associated with transportation and storage. The transportation and storage savings are further improved because using stand-up pouches eliminates or reduces the need for more containers and lids.

In recent times, beverage makers have begun to use stand-up pouches with gussets. And, unlike bottles and cans, nearly every single drop of liquid may be removed from a pouch. For food products that require cooking, stand-up pouches are desirable because they allow for the contents to be heated, re-heated or even cooked inside the stand-up pouch.

One potential drawback with stand-up pouches is the inability to form multiple compartments therein. The typical way of forming compartments in pouches without bottom gussets is by dividing the interior space by one of more heat seals. However, using one or more heat seals will likely damage and/or prevent the functionality of the bottom gussets of the stand-up pouches.

It would be desirable to provide a stand-up pouch having more flexibility with product packaging, especially in situations where a combination of products is offered.

SUMMARY

According to one embodiment, a gusseted stand-up flexible pouch comprises a pouch-forming structure including first and second opposing body panels, first and second opposing side gussets, a bottom gusset and at least one interior gusset. The bottom gusset extends between the first body panel and the second body panel. Each of the first and second side gussets is joined to the first body panel and the second body panel. The at least one interior gusset is joined to the first body panel and the second body panel. The at least one interior gusset is located between the first side gusset and the second side gusset. The at least one interior gusset divides an interior of the stand-up flexible pouch into a plurality of compartments.

According to another embodiment, a gusseted stand-up flexible pouch comprises a pouch-forming structure including first and second opposing body panels, first and second opposing side gussets, a bottom gusset and a plurality of interior gussets. The bottom gusset extends between the first body panel and the second body panel. Each of the first and second side gussets is joined to the first body panel and the second body panel. Each of the plurality of interior gussets is joined to the first body panel and the second body panel. Each of the plurality of interior gussets is located between the first side gusset and the second side gusset. The plurality of interior gussets divides an interior of the stand-up pouch into a plurality of compartments.

According to one method, a gusseted stand-up flexible pouch is formed. A sheet of film having a first side and a second side is provided. The sheet of film is folded to form a bottom gusset. The sheet of film has an open end opposite of the bottom gusset. Side gusset-forming material and interior gusset-forming material are placed between the first and second sides of the sheet of film. The side gusset-forming material is cut to form first and second side gussets. The first and second side gussets are sealed to interior surfaces of the first side and the second side. The interior gusset-forming material is sealed to interior surfaces of the first side and the second side to form at least one interior gusset. After cutting and sealing, the at least one interior gusset divides an interior of the stand-up flexible pouch into a plurality of compartments.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
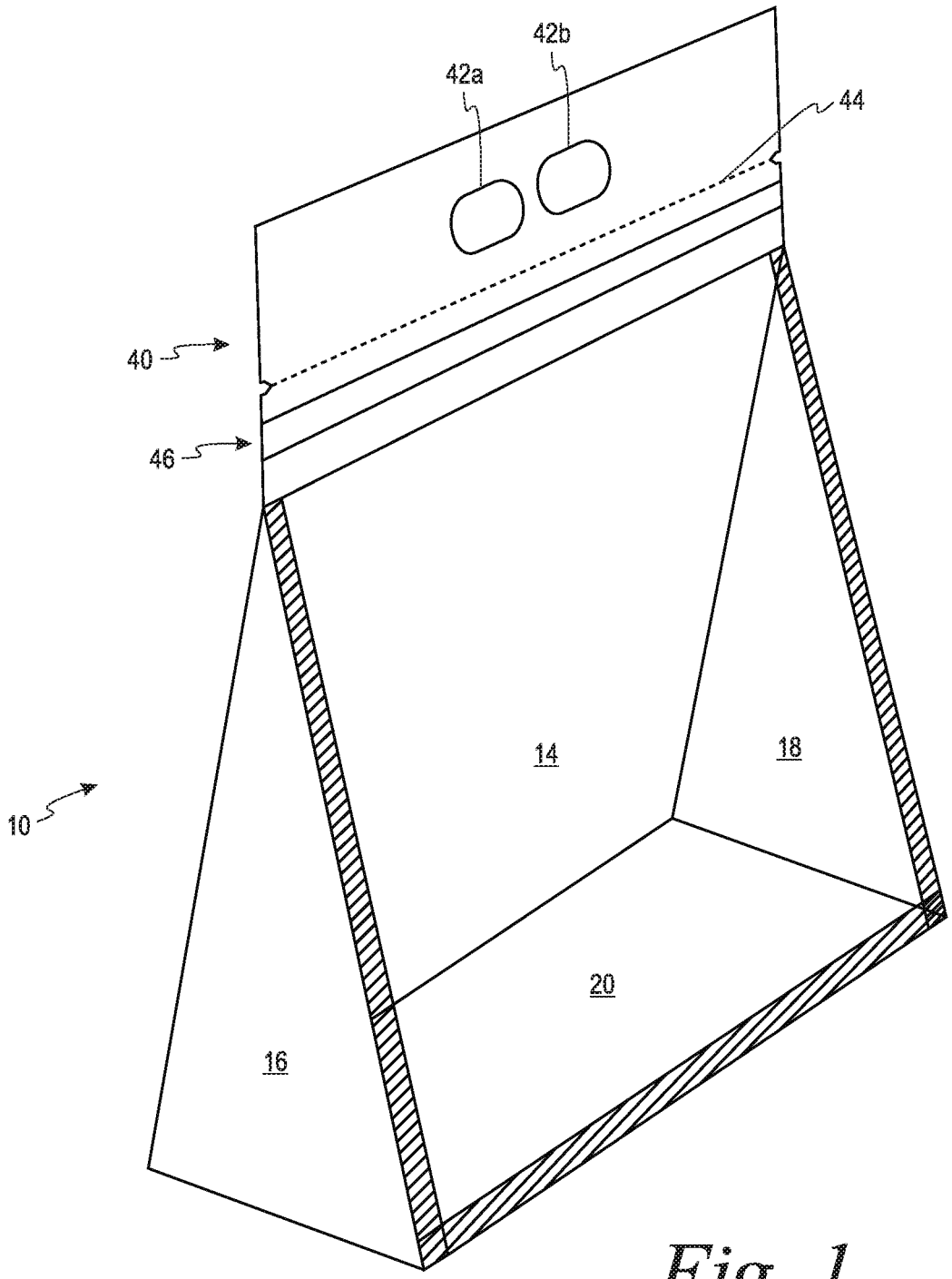
Fig. 1 PRIOR ART
FIG. 1 is a perspective view of a typical PRIOR ART stand-up pouch with exactly one inner compartment (depicted without a front panel to show the interior of the pouch).

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

As shown in PRIOR ART FIG. 1, a typical prior art stand-up pouch 10 includes a front body panel (not shown in FIG. 1), a back body panel 14, two side gussets 16, 18 and a bottom gusset 20. The stand-up pouch 10 includes a top portion 40 that forms hang or carry holes 42*a*, 42*b*. The top portion 40 of the stand-up pouch 10 includes tear-notches and/or tear-lines 44 and a resealable zipper 46. The stand-up pouch 10 of FIG. 1 includes exactly one compartment.

Figure 2A:
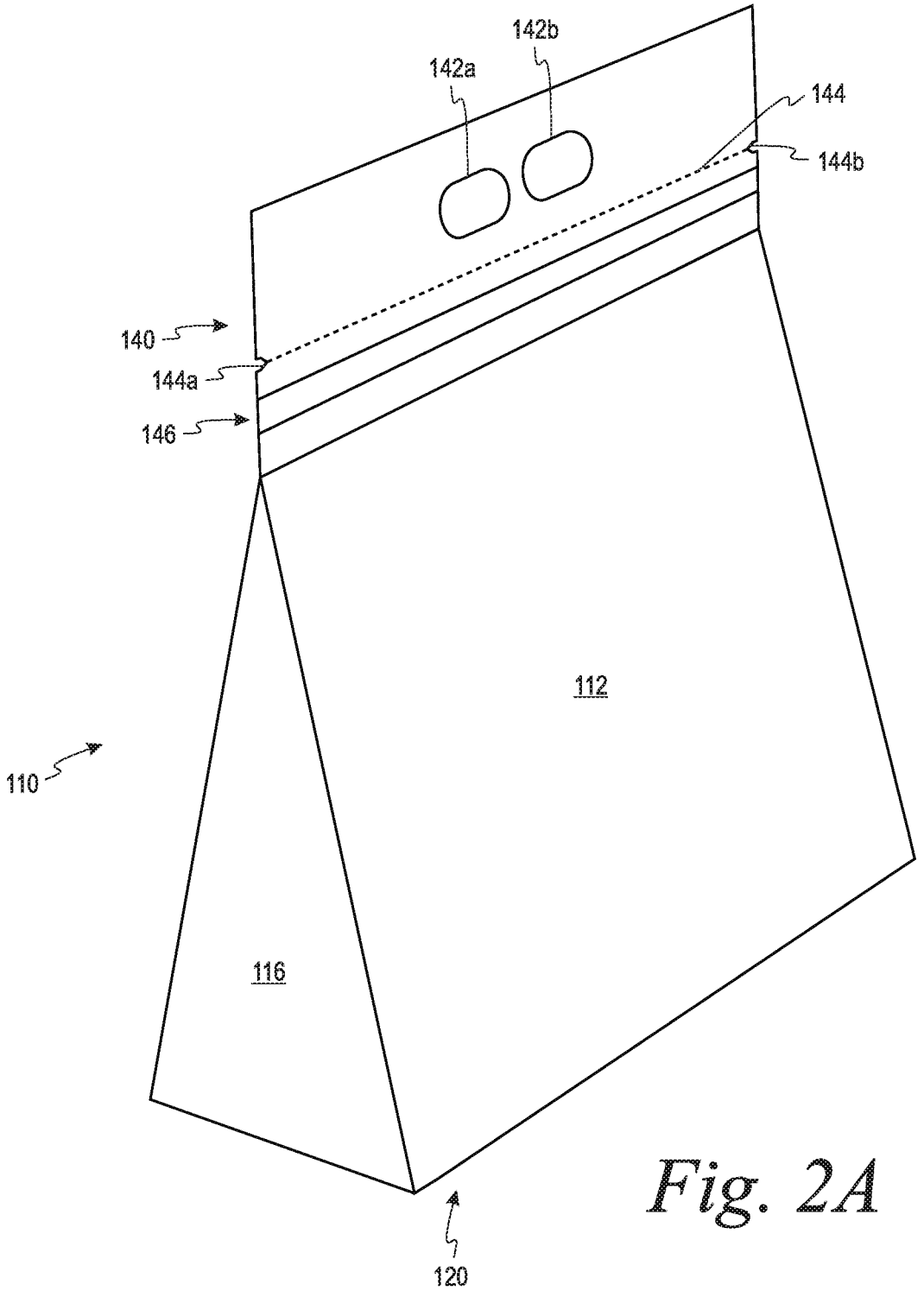
FIG. 2A is a perspective view of a two-compartment stand-up flexible pouch according to one embodiment of the present invention.
Figure 2B:
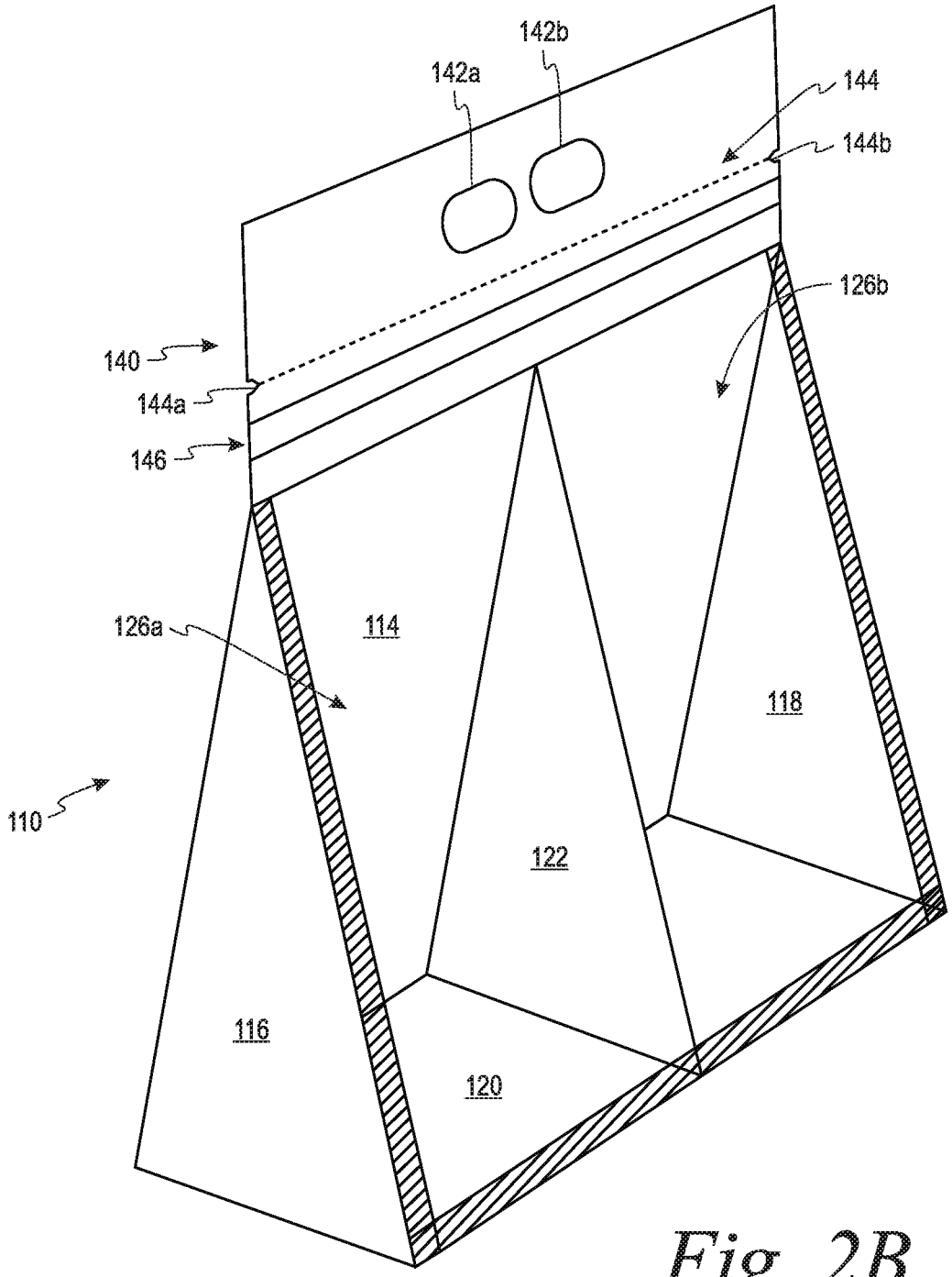
FIG. 2B is a perspective view of the two-compartment stand-up flexible pouch of FIG. 2A without the front panel to show the interior of the pouch.

Referring now to the present invention, FIGS. 2A and 2B depict a two-compartment stand-up flexible pouch 110 according to one embodiment. Stand-up flexible pouches are designed to stand on their own once they are filled with product. The main advantage of the stand-up flexible pouches of the present invention is the ability to package together two or more products, which may be products that are traditionally marketed together.

The stand-up flexible pouch 110 includes a first or front body panel 112 (FIG. 2A only), a second or back body panel 114 (FIG. 2B), two side gussets 116, 118, a bottom gusset 120, an interior gusset 122 (FIG. 2B only) and a top portion 140. FIG. 2B depicts the two-compartment stand-up pouch 110 without the first body panel 112 to show an interior of the pouch including the interior gusset 122.

The first and second body panels 112, 114 are desirably smoothly integrated with each other (i.e., without visible seaming). In such embodiments, this allows for high-quality graphics to be printed on the surfaces of the first and second body panels 112, 114 without significant distortion or unsightly seam lines.

The two side gussets 116, 118 of FIGS. 2A and 2B are shown as being a generally triangular shape. It is contemplated that other shapes may be used in forming the two side gussets. For example, the side gussets may be of a generally rectangular, generally square or a generally elongated oval shape. It is contemplated that the side gussets may be of other shapes.

The bottom gusset 120 extends between the first body panel 112 and the second body panel 114. The bottom gusset 120 allows the pouch to stand upright when it is filled with product. The bottom gusset 120 in the upright position forms a flat bottom in which the flat bottom has an interior surface and an exterior surface. Each of the first and second side gussets 116, 118 is joined to the first body panel 112 and the second body panel 114. Each of the first and second side gussets 116, 118 is also typically joined to the bottom gusset 120.

As shown in FIG. 2B, the interior gusset 122 divides the stand-up flexible pouch 110 into two compartments or chambers 126*a*, 126*b*. The interior gusset 122 is joined along its general periphery to the first body panel 112 and the second body panel 114. The interior gusset 122 is joined to the bottom gusset 120. The interior gusset 122 is shown as being connected or joined to the top portion 140 so as to define the two fully separated compartments 126*a*, 126*b* inside the stand-up flexible pouch 110. The interior gusset 122 is located between the first side gusset 116 and the second side gusset 118. The interior gusset 122 is configured to assist in preventing or inhibiting leakage of the contents between the respective compartments 126*a*, 126*b* of the stand-up flexible pouch 110. The two or more compartments may be of a similar size such as shown in FIG. 2B. In another embodiment, the compartments of a stand-up flexible pouch are of different sizes.

As shown in FIG. 2B, the interior gusset 122 is typically joined to the first and second body panels 112, 114 and the bottom gusset 120 from an inside attachment position. This is desirable to reduce or eliminate visible seaming on the exterior of the first and second body panels 112, 114, although some weld lines may be observable.

Figure 3A:
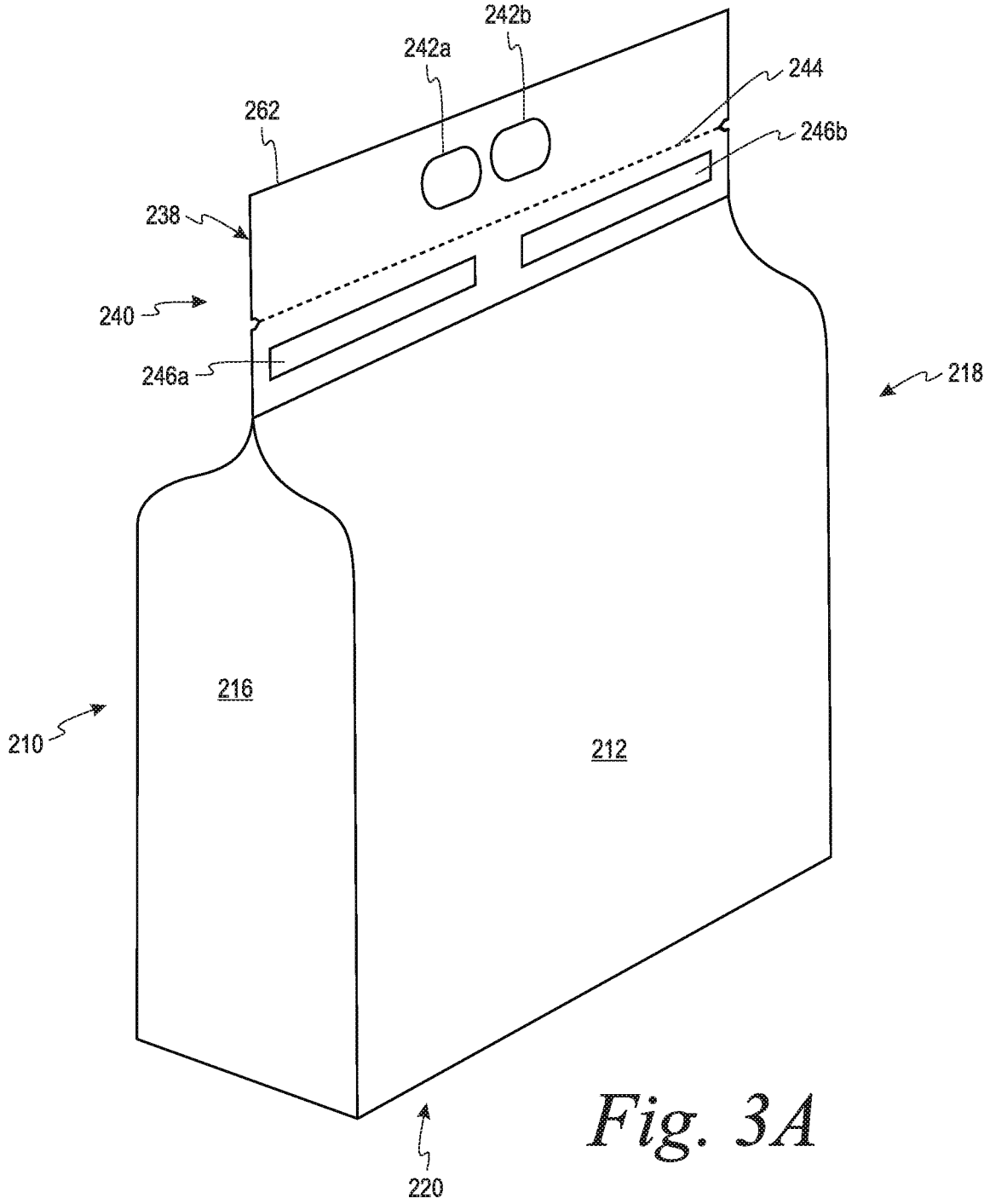
FIG. 3A is a perspective view of a two-compartment stand-up flexible pouch according to another embodiment of the present invention.
Figure 3B:
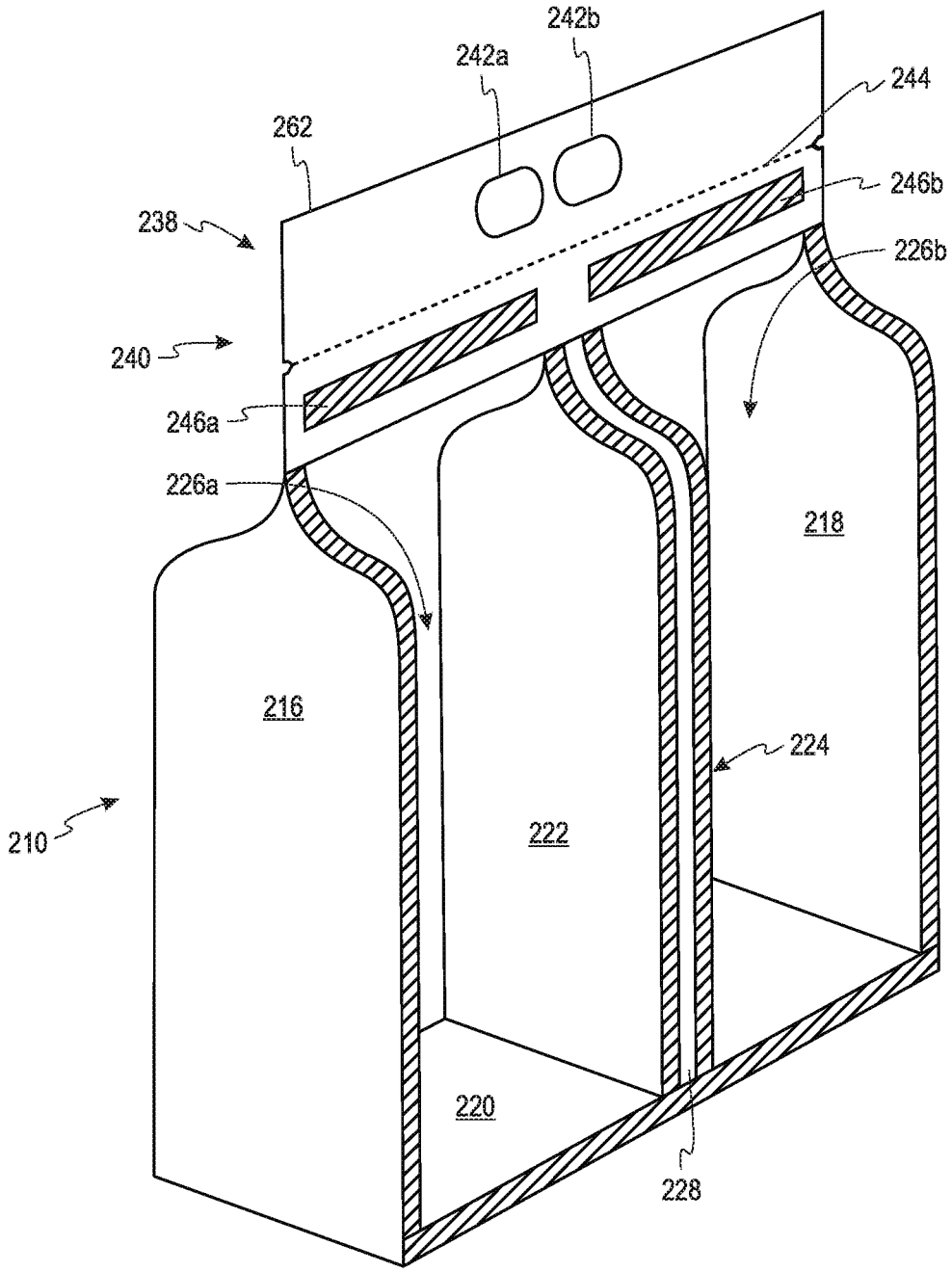
FIG. 3B is a perspective view of the two-compartment stand-up flexible pouch of FIG. 3A without the front panel to show the interior of the pouch.

Referring to FIGS. 3A and 3B, a two-compartment stand-up flexible pouch 210 is shown according to another embodiment. The stand-up pouch 210 includes a first or front body panel 212 (FIG. 3A only), a second or back body panel 214 (FIG. 3B), two side gussets 216, 218, a bottom gusset 220, a plurality of interior gussets 222, 224 (FIG. 3B only) and a top portion 240. FIG. 3B depicts the two-compartment stand-up flexible pouch 210 without the first body panel 212 to expose an interior of the pouch including the interior gussets 222, 224. The first body panel 212, the second body panel 214, the two side gussets 216, 218 and the bottom gusset 220 function similarly to that described above in the first body panel 112, the second body panel 114, the two side gussets 116, 118 and the bottom gusset 120, respectively. The bottom gusset 220 in the upright position forms a flat bottom in which the flat bottom has an interior surface and an exterior surface.

The interior gussets 222, 224 shown in FIG. 3B are adjacent and parallel to each other. In this embodiment, interior gussets 222, 224 have a narrow or enclosed space 228 therebetween. As shown in FIG. 3B, the enclosed space 228 is formed between the interior gusset 222, the interior gusset 224, the bottom gusset and the top portion 240 in which the enclosed space 228 is not accessible by either of the recloseable zippers 246*a*, 246*b*. It is contemplated that the interior gussets may be located immediately adjacent to each other with no space therebetween.

Each of the interior gussets 222, 224 is joined to the first body panel 212 and the second body panel 214. Each of the interior gussets 222, 224 is typically joined to the bottom gusset 220. As shown in FIG. 3B, the interior gussets 222, 224 are shown as being connected or joined to the top portion 240 so as to define two fully separated compartments or chambers 226*a*, 226*b* within the stand-up flexible pouch 210.

The arrangement of the interior gussets 222, 224 is desirable because it offers better separation between compartments, especially in the event that one of the two interior gussets 222, 224 is pierced, broken or has not been sealed properly to one of the surfaces.

Referring back to FIGS. 2A, 2B, the top portion 140 of the stand-up flexible pouch 110 forms hanging apertures or holes 142*a*, 142*b*. The hanging apertures or holes 142*a*, 142*b* assist in hanging the stand-up flexible pouch 110 in a peg display in retail stores. In such an embodiment, the hanging apertures or holes 142*a*, 142*b* are sized for placement onto the pegs.

It is contemplated that the stand-up flexible pouch may form a convenient handle to make it easier for consumers to carry the stand-up pouch with product. The handle of the stand-up flexible pouch may include one large opening that enables an entire hand to enter and subsequently assist in lifting the stand-up flexible pouch to be lifted. In another embodiment, the handle may include a plurality of finger holes to assist in lifting the stand-up pouch. It is also contemplated that straps and/or handles may be formed or attached to the stand-up flexible pouch at suitable locations to assist in lifting the stand-up pouch.

The stand-up flexible pouches of the present invention can be formed or fitted with various types of openings and closures. For example, the top portion 140 of the stand-up pouch 110 includes a line of weakness 144. The line of weakness desirably extends across the entire length of the stand-up flexible pouch such as shown in FIG. 2B. Referring to FIGS. 2A and 2B, each edge of the top portion has an inwardly-extending notch 144*a*, 144*b* to assist a user in accessing the line of weakness 144 that assists in removing a portion of the stand-up pouch.

The line of weakness 144 may be tear notches, pre-perforated tear strips, tear lines/strips. These lines of weakness may also be referred to as scored lines. The line of weakness is a feature typically located at the top portion to assist a user in opening the stand-up flexible pouch. It is also contemplated that the stand-up flexible pouch may be opened by cutting a top portion thereof in another embodiment.

The top portion may include a feature to open and close the stand-up flexible pouch. For example, the top portion 140 of the stand-up flexible pouch 110 includes a resealable fastener or zipper 146. The resealable fastener or zipper 146 is also referred to as a recloseable fastener or zipper in that it facilitates opening and closing of the fastener. The fastener 146 is attached between the first and second body panels 112, 114. The fastener 146 of FIGS. 2A, 2B extends generally across the opening of the stand-up pouch. The fastener 146 may include a slider that is slidably mounted thereto to facilitate opening and closing of the fastener. This type of closure is desirable to implement when it is important to keep contents as fresh as possible after initially opening the stand-up flexible pouch. Other types of closures that may be used with the stand-up flexible pouches include, but are not limited to, hook and loop seals, adhesive or magnetic closures.

Referring back to FIGS. 3A, 3B, the top portion 240 of the stand-up flexible pouch 210 forms hanging apertures or holes 242*a*, 242*b* that are similar to the apertures 142*a*, 142*b* described above. The top portion 240 includes a line of weakness 244 and a plurality of fasteners 246*a*, 246*b*. The line of weakness 244 is similar to the line of weakness 144 described above. The fasteners 246*a*, 246*b* of FIGS. 3A, 3B are similar to the fastener 146, except fasteners 246*a*, 246*b* only extend partially across the stand-up flexible pouch 210. Each of the fasteners 246*a*, 246*b* enables access to a respective individual compartment 226*a*, 226*b* of the stand-up flexible pouch 210.

Figure 3C:
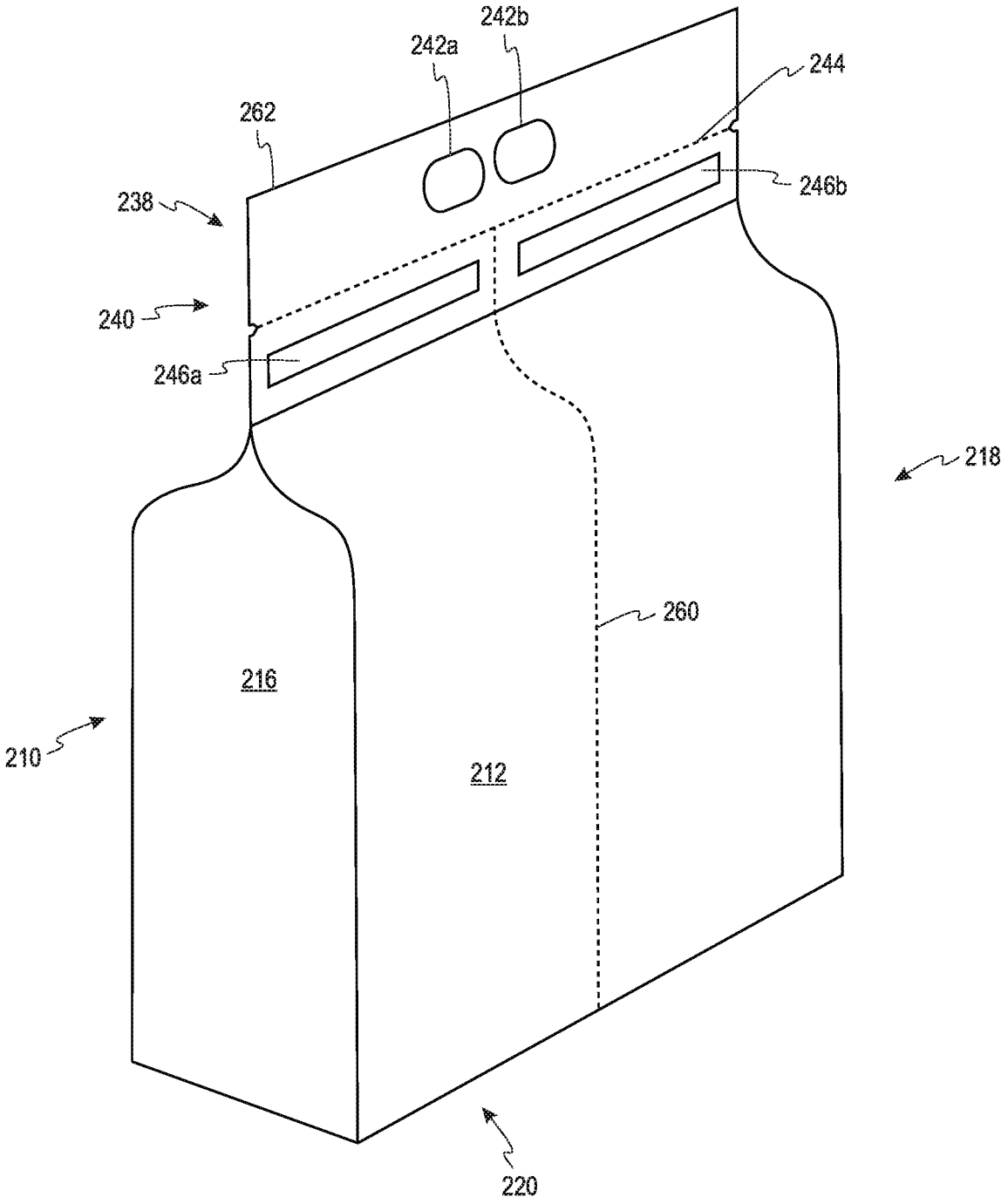
FIG. 3C is a perspective view of the two-compartment stand-up flexible pouch of FIG. 3A with a second line of weakness according to yet another embodiment.

Referring now to FIG. 3C, the stand-up pouch 210 of FIGS. 3A, 3B is shown with a line of weakness 260 in another embodiment. The line of weakness 260 assists in separating the compartments or chambers 226*a*, 226*b* (FIG. 3B) into two separate and distinct pouches after the section 238 has been removed via the line of weakness 244. The lines of weakness 260 extends from the line of weakness 244 down the front body panel 212 and around the bottom gusset 220 and around the second body panel 214 up to the line of weakness 244. It is contemplated that the line of weakness may extend fully through section 238 to edge 262 such that the stand-up flexible pouch may be separated into two pouches before opening.

The stand-up flexible pouches of the present invention may be fitted with one or more translucent or see-through windows, which are desirably positioned on the first or second body panels. The at least one window is desirably configured such that at least one if not each individual inner compartment may be viewed. For example, each of the compartments may be visible through a respective window that enables the respective contents to be seen by a user. This is shown in FIG. 4 in one embodiment.

Figure 4:
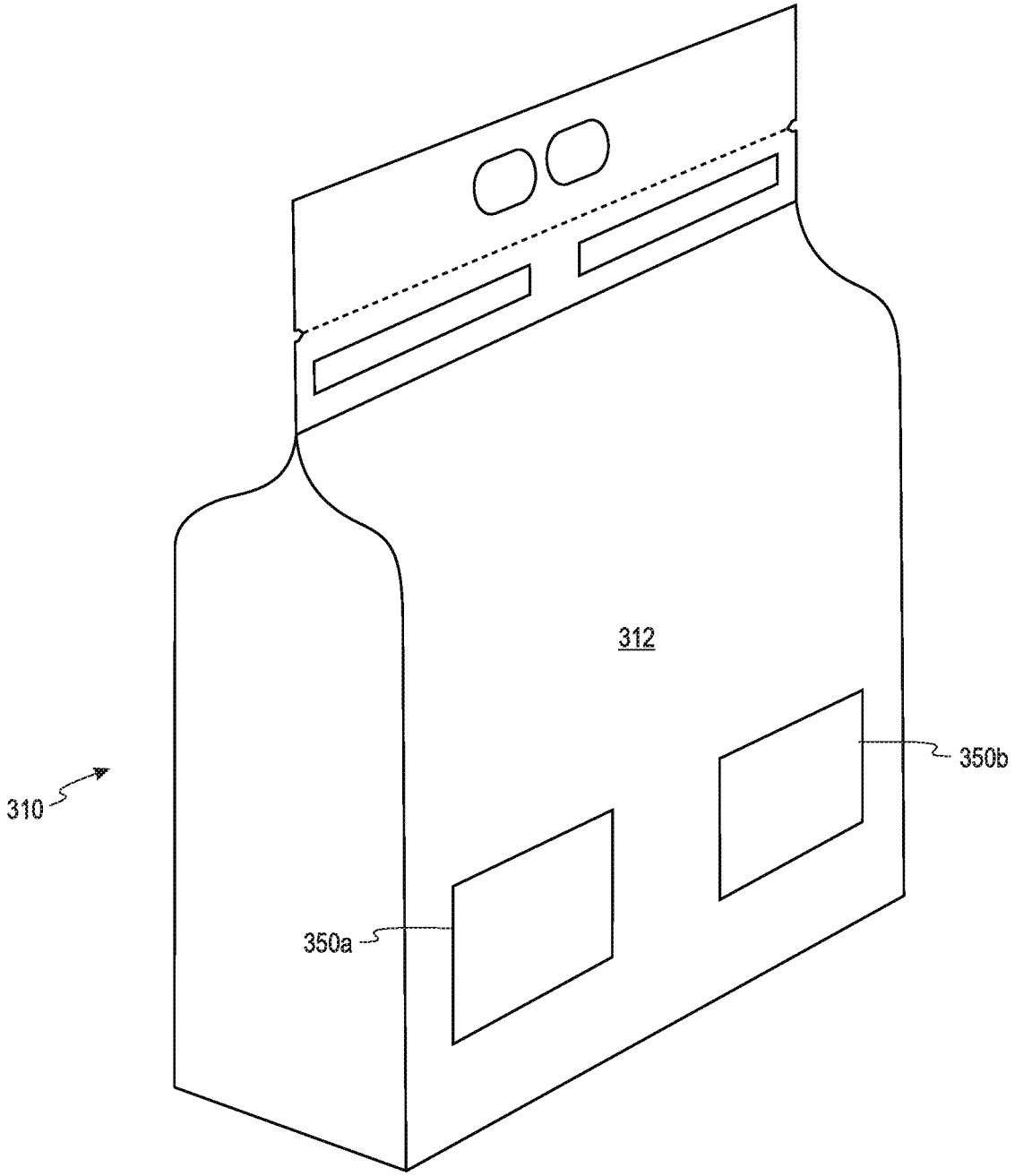
FIG. 4 is a perspective view of a two-compartment stand-up flexible pouch with a plurality of windows according to another embodiment of the present invention.

FIG. 4 depicts a stand-up flexible pouch 310 that is substantially similar to the stand-up pouch 210 described above. The stand-up pouch 310, however, includes a first or front body panel 312 that includes a plurality of generally rectangular windows 350*a*, 350*b* that allow a user to view the respective contents in each of the compartments. It is noted that the first body panel may include only one window. It is also contemplated that the windows may be shaped and sized different than the two generally rectangular windows 350*a*, 350*b* shown in FIG. 4. It is contemplated that the other stand-up flexible pouches of the present invention may include at least one window to assist in viewing the contents of the respective compartments. The windows 350*a*, 350*b* may be made of a translucent material. One non-limiting example for forming the windows is polyvinylidene chloride (PVDC). It is, however, contemplated that other materials may be used in forming the at least one window.

In addition to or instead of the above described openings and closures, the stand-up pouches of the present invention may be fitted with various types of pouring and/or dispensing mechanisms. Some non-limiting examples of pouring and/or dispensing mechanisms include, but are not limited to, spouts for liquids (with or without re-sealable caps), swing-out spouts for flowing powders, pump heads and/or trigger spray heads. It is contemplated that other pouring or dispensing mechanisms may be used in the stand-up flexible pouches of the present invention.

Figure 5:
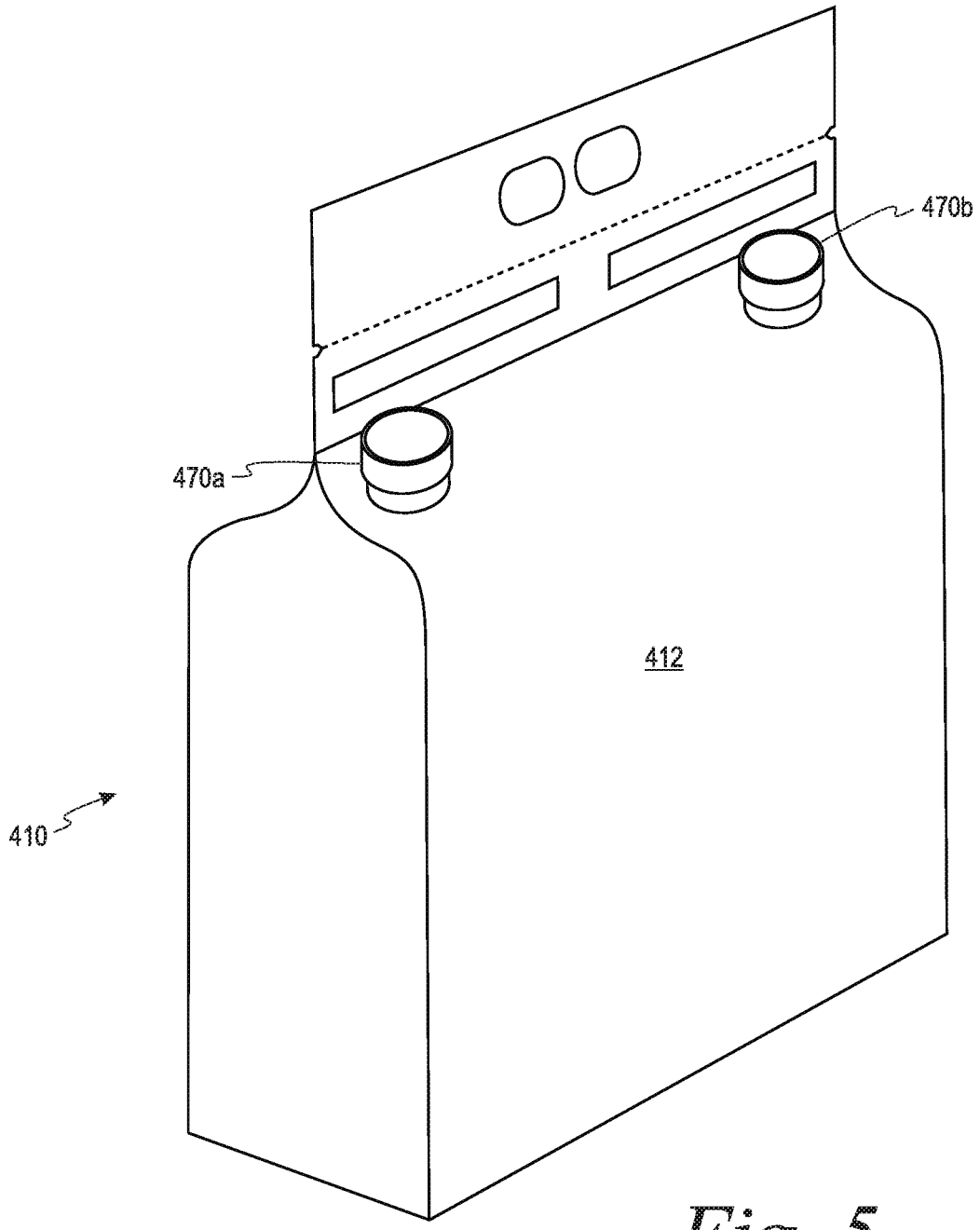
FIG. 5 is a perspective view of a two-compartment stand-up flexible pouch with a spout or dispensing mechanism according to another embodiment of the present invention.

One non-limiting example of a stand-up flexible pouch with a pouring or dispensing mechanism is shown in FIG. 5. FIG. 5 depicts a stand-up flexible pouch 410 that is substantially similar to the stand-up flexible pouch 210. The stand-up flexible pouch 410, however, includes a first body panel 412 having a plurality of pouring or dispensing mechanism 470*a*, 470*b* to assist in removing the contents from respective compartments. It is noted that the stand-up flexible pouch may include exactly one pouring mechanism, although, if used, two pouring mechanisms are often preferred. It is also contemplated that the pouring or dispensing mechanism may be different than that shown in FIG. 5. It is contemplated that the pouring or dispensing mechanism may be located in different positions than shown in FIG. 5. It is contemplated that the other stand-up flexible pouches of the present invention may include at least one pouring or dispensing mechanism.

It is desirable for each compartment in the stand-up pouches of the present invention to have its own individual opening, closure, pouring and/or dispensing mechanism. But, it is contemplated that in other embodiments that the stand-up pouches may be fitted with just one common opening, closure, pouring and/or dispensing mechanism.

The stand-up flexible pouches of the present invention may be designed for mixing together the contents of its various inner compartments before use or dispensing (e.g., by providing a mechanism for breaking or piercing the interior gusset(s) before dispensing the contents out of the pouch). For example, the stand-up flexible pouches may include an internal valve that breaks or bursts in response to a user's pressure on the pouch. This breaking or bursting results in the different products of the compartments intermixing with each other. It is contemplated that other mechanisms may be used in the stand-up flexible pouches of the present invention.

It is contemplated that the stand-up flexible pouch may include more than two compartments for storing product. For example, the stand-up flexible pouch may include three compartments formed by two spaced apart interior gussets or two pairs of spaced apart interior gussets.

Figure 6A:
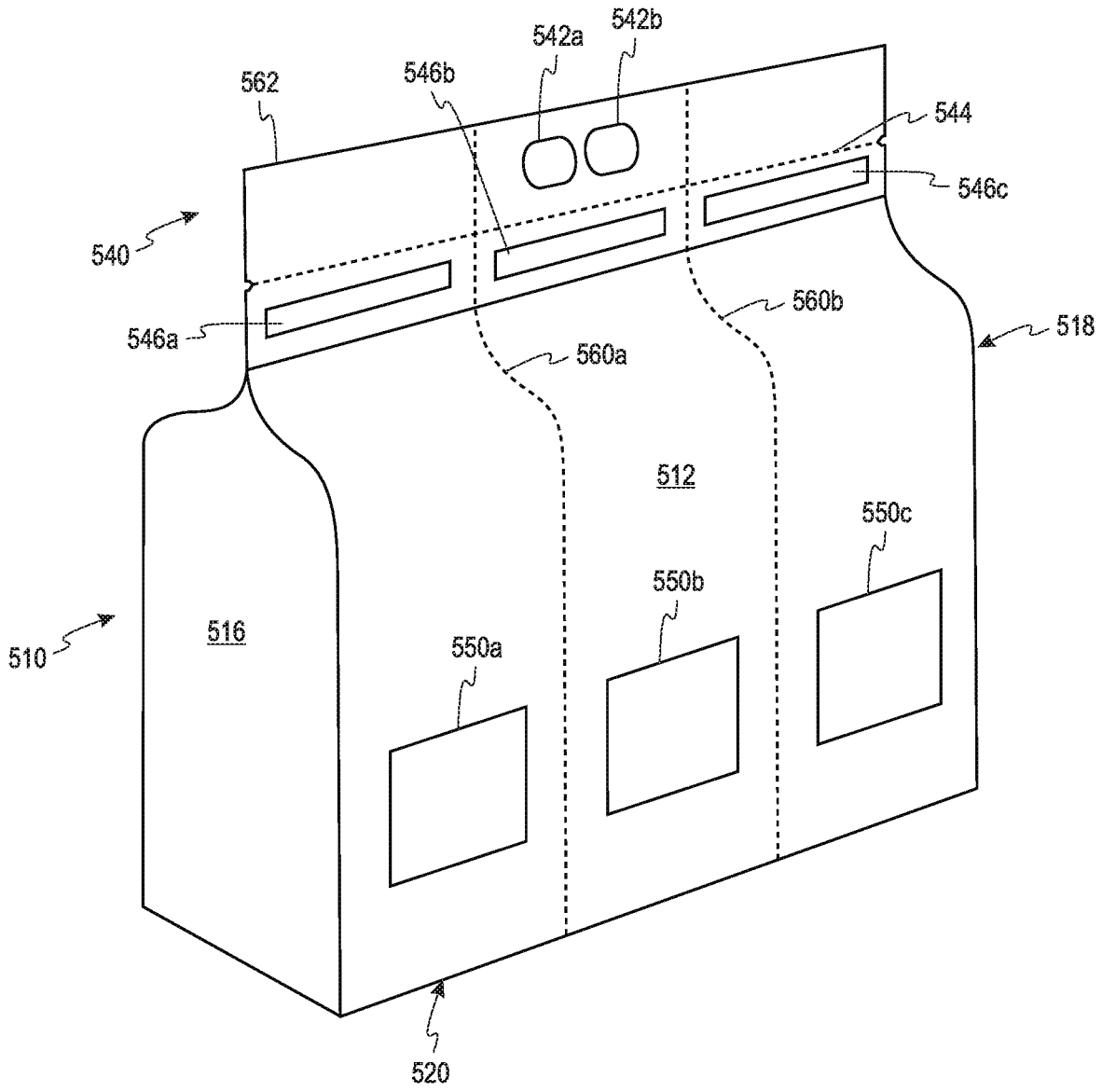
FIG. 6A is a perspective view of a three-compartment stand-up flexible pouch according to another embodiment of the present invention.
Figure 6B:
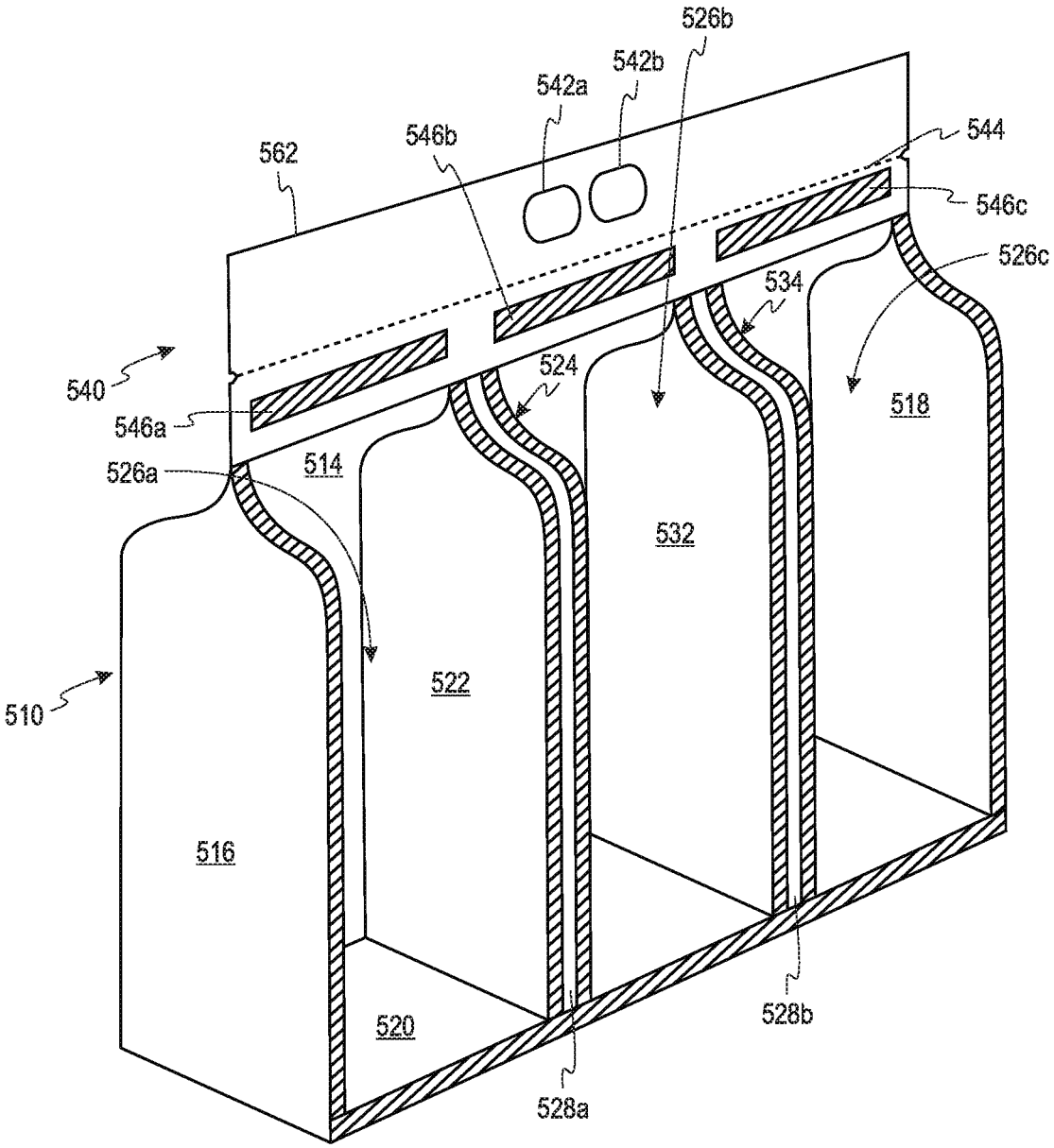
FIG. 6B is a perspective view of the three-compartment stand-up flexible pouch of FIG. 6A without the front panel to show the interior of the pouch.

One non-limiting example of a three compartment stand-up flexible pouch is shown in FIGS. 6A and 6B. FIG. 6A shows a three compartment stand-up flexible pouch 510 with a first or front body panel 512, while FIG. 6B shows the stand-up flexible pouch 510 without the first body panel 512. The stand-up flexible pouch 510 includes the first or front body panel 512 (FIG. 6A only), a second or back body panel 514 (FIG. 6B), two side gussets 516, 518, a bottom gusset 520, and a plurality of interior gussets 522, 524, 532, 534 (FIG. 6B) and a top portion 540. The bottom gusset 520 in the upright position forms a flat bottom in which the flat bottom has an interior surface and an exterior surface. The interior gussets 522, 524, 532, 534 divide the stand-up pouch 510 into three compartments 526 *a-c*. As shown in FIG. 6B, the interior gussets 522 and 524 have a space 528*a* therebetween, while the interior gussets 532 and 534 have a space 528*b* therebetween. As shown in FIG. 6B, the spaces 528*a*, 528*b* are formed between the interior gussets 522, 524, the bottom gusset and the top portion 540 in which the enclosed spaces 528*a*, 528*b* are not accessible by recloseable zippers 546*a-c*. It is contemplated that the interior gussets may be immediately adjacent to each other with little or no space therebetween.

The top portion 540 of the stand-up pouch 510 further forms hanging apertures 542*a*, 542*b*, a line of weakness 544 and includes fasteners 546*a-c*, which are similar to the above described hanging apertures, line of weaknesses and the fasteners. The stand-up flexible pouch 510 also includes windows 550*a-c* and lines of weakness 560*a*, 560*b* as shown in FIG. 6A that extend generally from the bottom pouch 520 to a top edge 562 of the top portion 540. The lines of weakness 560*a*, 560*b* extend from the top edge 562 all around the first body panel 512, the bottom gusset 520 and the second body panel 514. The lines of weakness 560*a*, 560*b* assist in separating the stand-up pouch 510 into three separate pouches if desired. The lines of weaknesses 560*a*, 560*b* can separate the stand-up pouch 510 into three separate pouches before opening the stand-up flexible pouch 510.

It is contemplated that a three compartment stand-up flexible pouch may be made from exactly two interior gussets.

It is contemplated that the number of compartments may be greater than the 2 or 3 shown in the non-limiting embodiments described above. For example, a stand-up flexible pouch may include 4, 5, 6 or even more compartments. It is contemplated that the compartments may have a similar or the same amount of interior space such as shown in FIG. 6B. In other embodiments, the compartments of the stand-up pouches are of different sizes.

The stand-up flexible pouches of the present invention may be made with suitable materials. In one embodiment, the stand-up flexible pouches comprise a polymer material. Some non-limiting example of polymeric materials that may be used in forming the stand-up flexible pouches include linear low density polyethylene (LLDPE), low density polyethylene (LDPE), metallocene-catalyzed linear low density polyethylene (mLLDPE), polyesters (e.g., polyethylene terephthlate (PET)), nylon, and combinations thereof. It is contemplated that other polymeric materials may be used. The polymeric materials selected are typically heat-sealable polymeric materials.

The stand-up flexible pouches of the present invention may be made of PVC (polyvinyl chloride) in a further embodiment. Such an embodiment typically uses a double-sided adhesive in constructing the stand-up flexible pouches.

The stand-up flexible pouches may comprise a single material or may comprise a plurality of materials. For example, the plurality of materials may be in a blended composition or a laminate. One non-limiting example of a flexible laminate material is a metallized PET. One non-limiting example of a metallized PET is aluminum and PET. Another embodiment is a metallized polyethylene such as a metallized LLDPE. It is desirable for the laminated polymeric material to be of a high grade that lends itself to custom printing. The stand-up flexible pouches may be made of other polymeric materials, polymeric composites and laminates, metal foil or combinations thereof.

The stand-up flexible pouches may also be made of biodegradable materials such as heat-sealable sugar cane. The stand-up flexible pouches may be made of other materials such as non-wovens. Although less desirable, it is contemplated that the stand-up flexible pouches may be made of materials such as cardboard, paper, rubber sheets and cloth in other embodiments.

It is contemplated that the above described materials may be used in various combinations in forming the stand-up flexible pouches. With regard to size, shape and dimensions, the stand-up flexible pouches of the present invention may be manufactured in various sizes and shapes suitable for storage, transport or retail selling.

It is contemplated that the stand-up flexible pouches may include an oxygen-barrier material. The oxygen-barrier material may be added as a separate layer or may be integrated within a material. The oxygen-barrier layer may be formed by materials that assist in preventing or inhibiting oxygen from entering the stand-up flexible pouch. These materials may include, but are not limited to, ethylene vinyl alcohol (EVOH). It is contemplated that other oxygen-barrier materials may be used in forming the stand-up flexible pouch.

The multi-compartment stand-up flexible pouches of the present invention may be used for convenient packaging of any type of suitable content including commercial or industrial products. The product may be in the form of dry powders, granular products, flowable solids, liquids, paste, gases, etc. Typical non-limiting examples of such products are: sports/nutrition, pharmaceuticals, cosmetics, beverages, foodstuffs, baby food, household (cleaners, detergents, softeners), dairy, pet food and motor oil. It is contemplated that other commercial or industrial products may be used in the stand-up flexible pouches of the present invention.

Due to the convenient combination of the at least two separate compartments within one single pouch, the stand-up pouch is uniquely suited for packaging and selling combos of two or more products that are normally sold together. These two or more products are typically used around the same time, mixed together at the point of use, or are combined in certain ratios and dosages.

Non-limiting examples of products include, but are not limited to: (1) shampoo and conditioner; (2) detergent and softener, detergent and bleach, or detergent and stain pretreatment; (3) pre-workout and post-workout sport supplements; (4) combos of multi-flavored food or sport supplements or pet food; (5) fertilizer and pesticide, or seed and fertilizer; (6) milk and cereal, milk and cookies, or other matching snacks; (7) multi-component products that are supposed to be mixed together just before use (e.g. cake mixes, beverage mixes, two-component adhesives, effervescent mixes, powdered or concentrated baby formula with water, reactive components, base resin and activator, car engine oil, fuel and transmission oil additives, etc.); or (8) various small parts or components within the same kit, which desirably should not come in contact with each other before final assembly.

In one method, the various components used in forming the multi-compartment stand-up flexible pouch are heated sealed with each other. The heat sealing may be performed by heating or ultrasonic sealing. The stand-up pouches may be formed by other methods such as chemical bonding. It is contemplated that other methods of attaching the various components of the stand-up flexible pouch may be employed.

According to one process, a flexible film may be used for forming the first and second body panels of the stand-up flexible pouch. The film may be a single layer film or a multi-layered film such as discussed above. The first and second body panels may be formed from separate individual films, but are typically formed from one individual film sheet. The side and interior gusset-forming materials are made separately from the body panels. The side and interior gusset-forming materials are located in the interior of the film that is to eventually form the first and second body panels. The gussets are typically heat-sealed to respective interior surfaces of the film that will eventually form the first and second body panels.

Figure 7A:
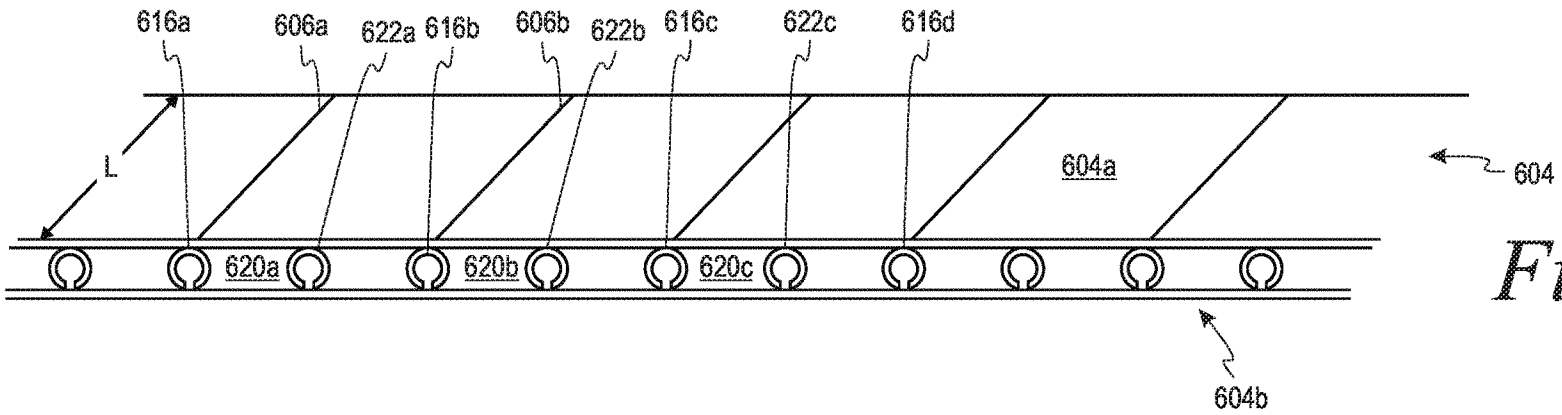
FIG. 7A is a top perspective view of film and a plurality of gusset-forming material according to one method.
Figure 7B:
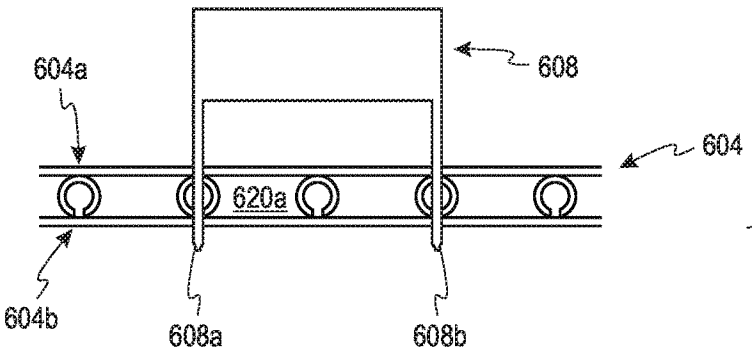
FIG. 7B is a side perspective of the film and the plurality of gusset-forming material of FIG. 7A.
Figure 7C:
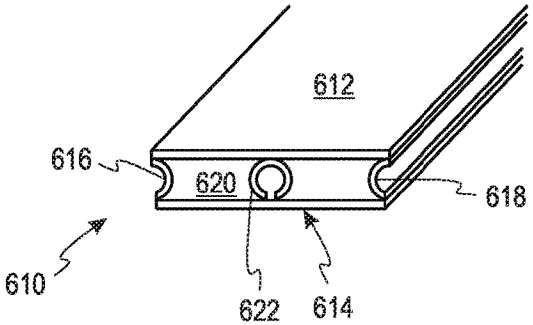
FIG. 7C is an enlarged bottom perspective view of the film and plurality of gussets of FIG. 7B after being separated and forming a pouch.

One non-limiting example of a process for forming a stand-up flexible pouch is shown in FIGS. 7A-7C. This process will be described as forming a two compartment stand-up flexible pouch with one interior gusset. Referring initially to FIG. 7A, a film 604 is shown with a first side 604*a* and a second side 604*b*. The film 604 may be a single layer film or a multi-layered film as discussed above. The film 604 for forming the first and second sides 604*a*, 604*b* may be formed from one individual sheet that has been folded. If a single sheet is used for eventually forming the first and second body panels, the bottom gusset-forming material is typically formed from the same sheet by folding. It is contemplated that the bottom gusset-forming material may be formed separately from the first and second sides and later joined.

In another embodiment, the film 604 may be made of two separate individual films that are sealed together. In this embodiment, the bottom gusset-forming material may be formed separately from the first and second sides and later joined. In another embodiment, the bottom gusset-forming material is formed from the sheets after they have been sealed together.

To show the placement of interior gusset-forming material and side gusset-forming material with respect to the film 604, a plurality of bottom gusset-forming material 620*a-c* is depicted as being a transparent film. The pouch-forming material includes the bottom gusset-forming material 620*a-c*, side gusset-forming material 616*a-d*, and interior gusset-forming material 622*a-c*. The bottom gusset-forming material 620*a-c* extends or bridges the material that will eventually form the first and second body panels of a stand-up flexible pouch. The interior gusset-forming material 622*a-c* and the side gusset-forming material 616*a-d* are located between the first side 604*a* and the second side 604*b* of the film 604. The film 604 has an open end (end opposite from the bottom gusset-forming material 620*a-c*) that will eventually form a top portion of the stand-up flexible pouch. To form the stand-up flexible pouches shown above, the interior gusset-forming material 622*a-c* and the side gusset-forming material 616*a-d* will not extend vertically across the film to the opening end. Thus, the length of the interior gusset-forming material 622*a-c* and the side gusset-forming material 616*a-d* will be less than length L of the film 604. The gussets may be located in-line or across the web direction (such as shown in FIG. 7A).

The film 604 depicts a plurality of generally vertical lines 606*a*, 606*b* extending across the film. These vertical lines 606*a*, 606*b* indicate where the film 604 will be eventually cut in the process of forming the stand-up flexible pouches. The cutting may be done by a reciprocating knife or other cutting mechanisms. The cutting mechanism may also perform simultaneously heat sealing with respect to the side gusset-forming material and the film.

Referring to FIG. 7B, a cutting mechanism 608 with reciprocating knives 608*a*, 608*b* is shown cutting the film 604. The cutting mechanism is typically an integrated device. The cutting mechanism 608 will cut the film 604 that eventually forms a two compartment stand-up flexible pouch of the present invention. It is contemplated that the cuts may be performed by separate mechanisms in other methods.

The side gusset-forming material 616*a-d* is joined to the first and second sides 604*a*, 604*b*. The side gusset-forming material is also typically joined to the bottom gusset-forming material. The interior gusset-forming material 622*a-c* is also joined to the first and second sides 604*a*, 604*b*. The interior gusset-forming material is also typically joined to the bottom gusset-forming material. This joining of the side and interior gusset-forming materials to the first and second sides may be done as discussed above by techniques such as sealing or bonding.

In one method, the sealing of the side and interior gusset-forming materials occurs before the cutting of the first and second sides 604*a*, 604*b*. In another method, the sealing of the side and interior gusset-forming materials occurs after cutting the first and second sides 604*a*, 604*b*. In a further method, the cutting and sealing occurs at about the same time.

After the pouch-forming material is cut and joined (e.g., sealed), a stand-up flexible pouch is formed. FIG. 7C shows an enlarged bottom perspective view of a stand-up flexible pouch 610. The stand-up flexible pouch 610 includes a first or front body panel 612, a second or back body panel 614, side gussets 616, 618, a bottom gusset 620 and an interior gusset 622. The stand-up flexible pouch 610 includes two compartments. As mentioned above, the bottom gusset 620 is shown as being transparent so that the side gusset 616 and the interior gusset 622 can be seen.

Figure 8A:
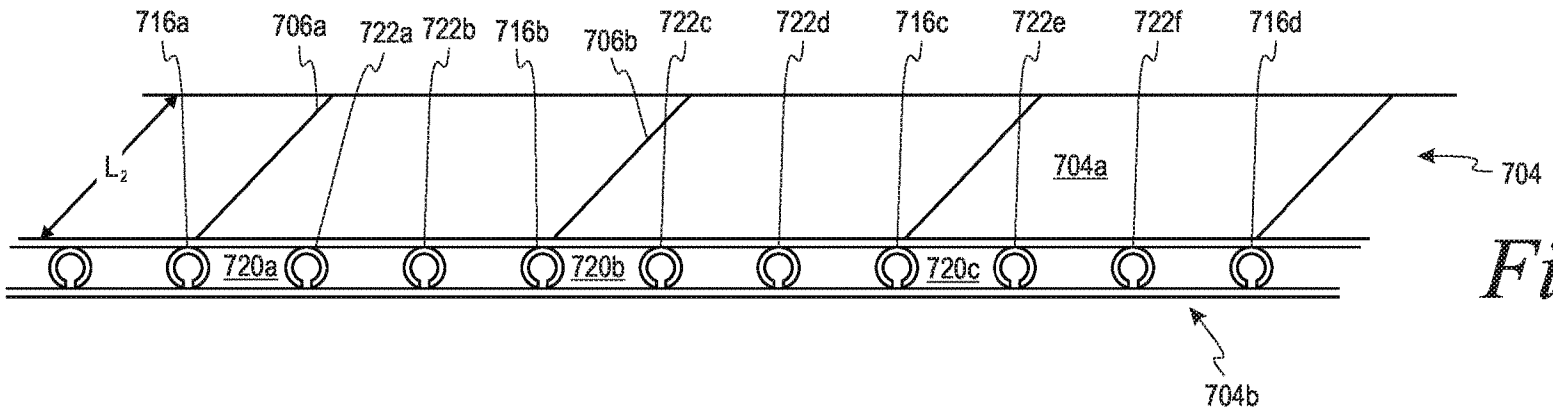
FIG. 8A is a top perspective view of film and a plurality of gusset-forming material according to one method.
Figure 8B:
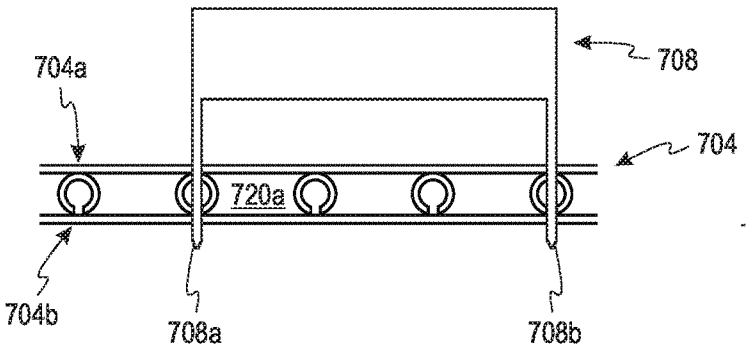
FIG. 8B is a side perspective of the film and the plurality of gusset-forming material of FIG. 8A.
Figure 8C:
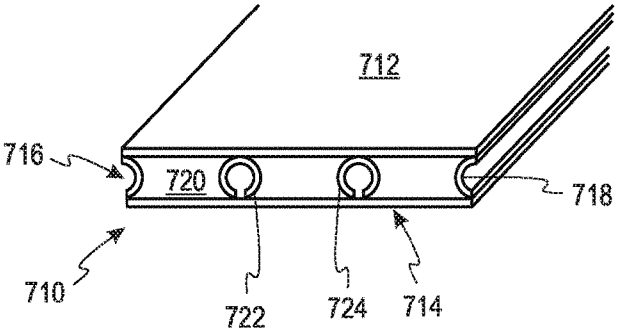
FIG. 8C is an enlarged bottom perspective view of the film and plurality of gussets of FIG. 8B after being separated and forming a pouch.

Another non-limiting example of a process for forming a stand-up flexible pouch is shown in FIGS. 8A-8C. This process will be described as forming a three compartment stand-up flexible pouch with two interior gussets. Referring initially to FIG. 8A, a film 704 is shown with a first side 704*a* and a second side 704*b*. The film 704 for forming the first and second sides 704*a*, 704*b* may be formed from one individual sheet that has been folded. If a single sheet is used for eventually forming the first and second body panels, the bottom gusset-forming material is typically formed from the same sheet by folding. It is contemplated that the bottom gusset-forming material may be formed separately from the first and second sides and later joined.

In another embodiment, the film 704 may be made of two separate individual films that are sealed together. In this embodiment, the bottom gusset-forming material may be formed separately from the first and second sides and later joined. In another embodiment, the bottom gusset-forming material is formed from the sheets after they have been sealed together.

To show the placement of interior gusset-forming material and side gusset-forming material with respect to the film 704, a plurality of bottom gusset-forming material 720*a-c* is depicted as being a transparent film. The pouch-forming material includes the bottom gusset-forming material 720*a-c*, side gusset-forming material 716*a-d* and interior gusset-forming material 722*a-f*. The bottom gusset-forming material 720*a-c* extends or bridges the material that will eventually form the first and second body panels of a stand-up flexible pouch. The interior gusset-forming material 722*a-f* and the side gusset-forming material 716*a-d* are located between the first side 704*a* and the second side 704*b* of the film 704. The film 704 has an open end (end opposite from the bottom gusset-forming material 720*a-c*) that will eventually form a top portion of the stand-up flexible pouch. To form the stand-up flexible pouches shown above, the interior gusset-forming material 722*a-f* and the side gusset-forming materials 716*a-d* will not extend vertically across the film to the opening end. Thus, the length of the interior gusset-forming material 722*a-f* and the side gusset-forming materials 716*a-d* will be less than length L2 of the film 704. The gussets may be located in-line or across the web direction (such as shown in FIG. 8A).

The film 704 depicts a plurality of generally vertical lines 706*a*, 706*b* extending across. These vertical lines 706*a*, 706*b* indicate where the film 704 will be eventually cut in the process of forming the stand-up flexible pouches. As discussed above, the cutting may be done by a reciprocating knife or other cutting mechanisms that may also perform simultaneously heat sealing with respect to the side gusset-forming material and the film.

Referring to FIG. 8B, a cutting mechanism 708 with reciprocating knives 708*a*, 708*b* is shown cutting the film 704. The cutting mechanism is typically an integrated device. The cutting mechanism 708 will cut the film 704 that eventually forms a three compartment stand-up flexible pouch of the present invention. It is contemplated that the cut may be performed by separate mechanisms in other embodiments.

The side gusset-forming material 716*a-d* is joined to the first and second sides 704*a*, 704*b*. The side gusset-forming material is also typically joined to the bottom gusset-forming material. The interior gusset-forming material 722*a-f* is also joined to the first and second sides 704*a*, 704*b*. The interior gusset-forming material is also typically joined to the bottom gusset-forming material. This joining of the side and interior gusset-forming materials to the first and second sides may be done as discussed above by techniques such as sealing or bonding.

In one method, the sealing of the side and interior gusset-forming materials occurs before the cutting of the first and second sides 704*a*, 704*b*. In another method, the sealing of the side and interior gusset-forming materials occurs after cutting the first and second sides 704*a*, 704*b*. In a further method, the cutting and sealing occurs at about the same time.

After the pouch-forming material is cut and joined (e.g., sealed), a stand-up flexible pouch is formed. FIG. 8C shows an enlarged bottom perspective view of a stand-up flexible pouch 710. The stand-up flexible pouch 710 includes a first or front body panel 712, a second or back body panel 714, side gussets 716, 718, a bottom gusset 720 and a plurality of interior gussets 722, 724. The stand-up flexible pouch 710 includes three compartments. As mentioned above, the bottom gusset 720 is shown as being transparent so that the side gusset 716 and the interior gussets 722, 724 can be seen.

If used in either of the processes described above with respect to FIGS. 7A-C and 8A-C, the features of the top portion such as fasteners, line of weakness, hanging apertures etc. are inserted or formed using known techniques in the art. The line of weakness and hanging apertures are typically formed in-line using a punching device. The fasteners are typically inserted and heat sealed to an interior of the first and second body panels. Also, if used, windows may be formed by having the film with selected areas of different material that allow for viewing of the product.

The pouches may be formed using a horizontal pouch-forming process or a vertical pouch-forming process.

In another method, the stand-up pouches may be manufactured by joining together two or more single-compartment pouches. This is less desirable because it results in a visible exterior seam where the joining occurs, but otherwise still exhibits the advantages of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A method of forming a gusseted stand-up flexible pouch, the method comprising:

providing a sheet of film having a first side and a second side;

folding the sheet of film to form a bottom gusset, the sheet of film having an open end opposite of the bottom gusset;

placing a first and a second side gusset-forming material between the first and second sides of the sheet of film;

placing interior gusset-forming material between the first and second sides of the sheet of film;

cutting the first and second side gusset-forming material to form first and second side gussets;

sealing the first and second side gussets to interior surfaces of the first side and the second side;

sealing the interior gusset-forming material to interior surfaces of the first side and the second side to form a plurality of interior gussets, forming at least one line of weakness, the at least one line of weakness extending from the first side around the bottom gusset and to the second side, and providing at least two recloseable zippers, the at least two recloseable zippers being located at a top portion opposite of the bottom gusset;

wherein after the cutting and sealing, the plurality of interior gussets divides an interior of the stand-up flexible pouch into at least two compartments, wherein the at least one line of weakness assists in separating the pouch-forming structure into at least two separated pouches, wherein the stand-up flexible pouch is configured to have the bottom gusset form a flat bottom in an upright configuration, the flat bottom extending between the first and second sides, the flat bottom further extending between the first and second side gussets, the flat bottom having an interior surface and an exterior surface, the entire exterior surface of the flat bottom is configured to contact a flat surface when in an upright configuration.

2. The method of claim 1, wherein the first and second sides of the film are integrally connected.

3. The method of claim 1, wherein the first and second sides of the film are joined together.

4. The method of claim 1 further including sealing the first and second side gussets to the bottom gusset.

5. The method of claim 1 further including sealing the interior gusset-forming material to the bottom gusset.

6. The method of claim 1 further including forming a line of weakness on a top portion opposite of the bottom gusset.

7. The method of claim 1, wherein the plurality of compartments is exactly two compartments.

8. The method of claim 1, wherein each of the plurality of compartments has an individual opening.

9. The method of claim 1, wherein the first and second opposing side gussets are smoothly integrated without visible seaming.

10. The method of claim 1, wherein the stand-up flexible pouch comprises polymeric materials.

11. The method of claim 1, wherein the stand-up flexible pouch comprises a metallized polymeric material.

12. The method of claim 1, wherein the plurality of interior gussets is exactly two interior gussets.

13. The method of claim 1, wherein each of the at least two recloseable zippers includes a slider.

14. A method of forming a gusseted stand-up flexible pouch, the method comprising:

providing a sheet of film having a first side and a second side;

folding the sheet of film to form a bottom gusset, the sheet of film having an open end opposite of the bottom gusset;

placing a first and a second side gusset-forming material between the first and second sides of the sheet of film;

placing interior gusset-forming material between the first and second sides of the sheet of film;

cutting the first and second side gusset-forming material to form first and second side gussets;

sealing the first and second side gussets to interior surfaces of the first side and the second side;

sealing the interior gusset-forming material to interior surfaces of the first side and the second side to form a plurality of interior gussets, forming at least one line of weakness, the at least one line of weakness extending from the first side around the bottom gusset and to the second side, and providing at least two recloseable zippers, the at least two recloseable zippers being located at a top portion opposite of the bottom gusset;

wherein after the cutting and sealing, the plurality of interior gussets divides an interior of the stand-up flexible pouch into at least two compartments, wherein the at least one line of weakness assists in separating the pouch-forming structure into at least two separated pouches, wherein the stand-up flexible pouch is configured to have the bottom gusset form a flat bottom in an upright configuration, the flat bottom extending between the first and second sides, the flat bottom further extending between the first and second side gussets, the flat bottom having an interior surface and an exterior surface, the entire exterior surface of the flat bottom is configured to contact a flat surface when in an upright configuration, wherein the stand-up flexible pouch forms an enclosed space between a first one of the plurality of interior gussets, a second one of the plurality of gussets, the bottom gusset and the top portion, the enclosed space not being accessible by the at least two recloseable zippers.

15. The method of claim 14, wherein the plurality of compartments is exactly two compartments.

16. The method of claim 14, wherein each of the plurality of compartments has an individual opening.

17. The method of claim 14, wherein the stand-up flexible pouch comprises polymeric materials.

18. The method of claim 14, wherein the plurality of interior gussets is exactly two interior gussets.

19. A method of forming a gusseted stand-up flexible pouch, the method comprising:

providing a sheet of film having a first side and a second side;

folding the sheet of film to form a bottom gusset, the sheet of film having an open end opposite of the bottom gusset;

placing a first and a second side gusset-forming material between the first and second sides of the sheet of film;

placing interior gusset-forming material between the first and second sides of the sheet of film;

cutting the first and second side gusset-forming material to form first and second side gussets;

sealing the first and second side gussets to interior surfaces of the first side and the second side;

sealing the interior gusset-forming material to interior surfaces of the first side and the second side to form a plurality of interior gussets, forming at least one line of a weakness, the at least one line of weakness extending from the first side around the bottom gusset and to the second side, and providing at least one recloseable zipper, the at least one recloseable zipper being located at a top portion opposite of the bottom gusset;

wherein after the cutting and sealing, the plurality of interior gussets divides an interior of the stand-up flexible pouch into at least two compartments, wherein the at least one line of weakness assists in separating the pouch-forming structure into at least two separated pouches, wherein the stand-up flexible pouch is configured to have the bottom gusset form a flat bottom in an upright configuration, the flat bottom extending between the first and second sides, the flat bottom further extending between the first and second side gussets, the flat bottom having an interior surface and an exterior surface, the entire exterior surface of the flat bottom is configured to contact a flat surface when in an upright configuration, wherein the stand-up flexible pouch forms an enclosed space between a first one of the plurality of interior gussets, a second one of the plurality of gussets, the bottom gusset and the top portion, the enclosed space not being accessible by the at least one recloseable zipper.

* * * * *